US009181730B1

(12) United States Patent
Peng

(10) Patent No.: US 9,181,730 B1
(45) Date of Patent: Nov. 10, 2015

(54) DRIVING STRUCTURE OF ELECTRONIC LOCK

(71) Applicant: Fu-Chang Peng, New Taipei (TW)

(72) Inventor: Fu-Chang Peng, New Taipei (TW)

( * ) Notice: Subject to any disclaimer, the term of this patent is extended or adjusted under 35 U.S.C. 154(b) by 0 days.

(21) Appl. No.: 14/574,393

(22) Filed: Dec. 18, 2014

(51) Int. Cl.
*E05B 47/00* (2006.01)
*E05B 63/08* (2006.01)

(52) U.S. Cl.
CPC ..... *E05B 47/0001* (2013.01); *E05B 63/08* (2013.01)

(58) Field of Classification Search
CPC ..... E05B 47/0012; E05B 47/068; E05B 2047/0026; E05B 47/0673; E05B 65/1053; E05B 55/005; E05B 63/16; E05B 81/10; Y10T 70/5416; Y10T 70/7062; Y10T 70/7107; Y10T 292/1021; Y10T 292/57; Y10T 70/05
USPC ..... 70/224, 275, 277, 279.1, 283, 283.1; 292/336.3
See application file for complete search history.

(56) References Cited

U.S. PATENT DOCUMENTS 5,018,375 A * 5/1991 Tully ..... 70/472
5,083,122 A * 1/1992 Clark ..... 340/5.22
5,335,948 A * 8/1994 Norton et al. ..... 292/169.23
5,421,178 A * 6/1995 Hamel et al. ..... 70/283
5,628,216 A * 5/1997 Qureshi et al. ..... 70/278.7
5,687,507 A * 11/1997 Beran ..... 49/340
5,694,798 A * 12/1997 Nunez et al. ..... 70/283
5,782,118 A * 7/1998 Chamberlain et al. ..... 70/278.3
5,794,472 A * 8/1998 Kester et al. ..... 70/472
5,809,815 A * 9/1998 Lee ..... 70/472
5,845,522 A * 12/1998 Shen ..... 70/224
5,931,430 A * 8/1999 Palmer ..... 248/311.2
5,960,656 A * 10/1999 Yao ..... 70/472
6,189,351 B1 * 2/2001 Eagan et al. ..... 70/472
6,279,360 B1 * 8/2001 Shen ..... 70/224
6,575,006 B1 * 6/2003 Don ..... 70/472
7,918,114 B2 * 4/2011 Walsh, III ..... 70/283
8,356,499 B2 * 1/2013 Peng ..... 70/283
8,844,330 B2 * 9/2014 Moon et al. ..... 70/224
2014/0196509 A1 * 7/2014 Moon et al. ..... 70/1.5

* cited by examiner

*Primary Examiner* — Suzanne Barrett
(74) *Attorney, Agent, or Firm* — Leong C. Lei

(57) ABSTRACT

An improved driving structure of an electronic lock includes an outdoor assembly, a lock core, an indoor assembly, and a latch bolt. The outdoor assembly is mounted to an outside surface of a door panel. The indoor assembly is mounted to an inside surface of the door panel. The lock core is arranged between the outdoor assembly and the indoor assembly and coupled thereto. The lock core is operatively coupled to the latch bolt. As such, an improved structure of an electronic lock is constructed. When a user enters a correct combination of codes, the electrical valve of the lock core stretches the projection block outward to engage the second stopper so as to allow the exterior handle and the lock core to be operated synchronously for unlocking. Without the combination of codes, a key may be used to unlock the door.

3 Claims, 14 Drawing Sheets

DRIVING STRUCTURE OF ELECTRONIC LOCK

(a) TECHNICAL FIELD OF THE INVENTION

The present invention generally relates to an electronic lock, and more particularly to an improved electronic lock driving structure that involves an improvement of a structure of a driving valve.

(b) DESCRIPTION OF THE PRIOR ART

A conventional electronic lock comprises a electrical valve that comprises a motor connected to a rotatable member including a thread and coupled to a spring having an end carrying a block. When the thread-included rotatable member is rotated, the spring is caused to move along a spring track for compression and extension of the spring in a backward and forward direction so that the block of the valve is stretched out to engage a mechanism. The operation is achieved by having the valve extending forward or retracting backward with the resiliency of the spring and the thread. However, after having been long put in operation, the spring is susceptible to undesired deformation due to long compression by external forces and eventually loses the resiliency thereof. The extension/retraction stroke of the valve would then be undesirably shortened, making it no longer possible to engage the mechanism. Under such a condition, the electronic lock must be maintained to have the valve substituted.

Further, the valve, in the overall construction thereof, comprises a block that is received in a lock core. The lock core comprises a latch arrestor that is maintained by a spring to extend outward. Since the two members are located very close, the block often interferes with extension and retraction of the spring of the latch, leading to failure of unlocking or the latch being unable to return after being unlocked.

To overcome the above shortcomings of the prior art devices, the present invention provides a driving structure of an electronic lock, which possesses at least the following advantages:

(1) The present invention involves an improved valve, which has a robust structure and also shows flexibility so as not to be easy to deform and change shape.

(2) The present invention additionally involves a separation plate, which effectively separates an electronic valve and a spring to prevent interference with each other.

(3) The present invention shows excellent industrial utilization.

In light of the forgoing, the present invention aims to provide an improved driving structure of an electronic lock that has advantages in respect of safety, convenience, and economics and that overcomes the shortcomings of the prior art.

SUMMARY OF THE INVENTION

In view of the drawbacks that a conventional electronic lock suffers disability of unlocking due to shortened stroke of an electronic valve and interferences of the electronic valve with a latch bolt, an object of the present invention is to provide an improved driving structure of an electronic lock, which comprises an improved valve that has a robust structure and shows flexibility so as not to be easy to deform and change shape, and additionally involves a separation plate that effectively separates an electronic valve and a spring to prevent interference with each other so as to extend the lifespan and be not easy to damage.

To achieve the above object, the present invention provides an improved driving structure of an electronic lock, an outdoor assembly, a lock core, an indoor assembly, and a latch bolt, the outdoor assembly being mounted to an outside surface of a door panel, the indoor assembly being mounted to an inside surface of the door panel, the lock core being arranged between the outdoor assembly and the indoor assembly and coupled thereto, the lock core being operatively coupled to the latch bolt; characterized in that the lock core comprises a lock core base, elastic elements, a separation plate, a latch bolt engagement member, an electrical valve, a first stopper, a first ring, a lock core cover, a guide plate, a second ring, a second stopper, and a base fixing member, the elastic elements and the separation plate being sequentially disposed in the lock core base and then coupled to the latch bolt engagement member, the electrical valve being received in the first stopper and the lock core base, the first ring and the lock core cover being sequentially fit to the first stopper and the lock core base, the guide plate being disposed in the second stopper, the second stopper extending, in sequence, through the second ring and the lock core base and fixed by the base fixing member in the lock core base. As such, an improved driving structure of an electronic lock is constructed.

With the improved valve having a robust structure and showing flexibility so as not to be easy to deform and change shape, and a separation plate being additionally provided inside the lock core to effectively separate an electronic valve and a spring to prevent interference with each other, advantages of extending lifespan and being not easy to damage are achieved.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
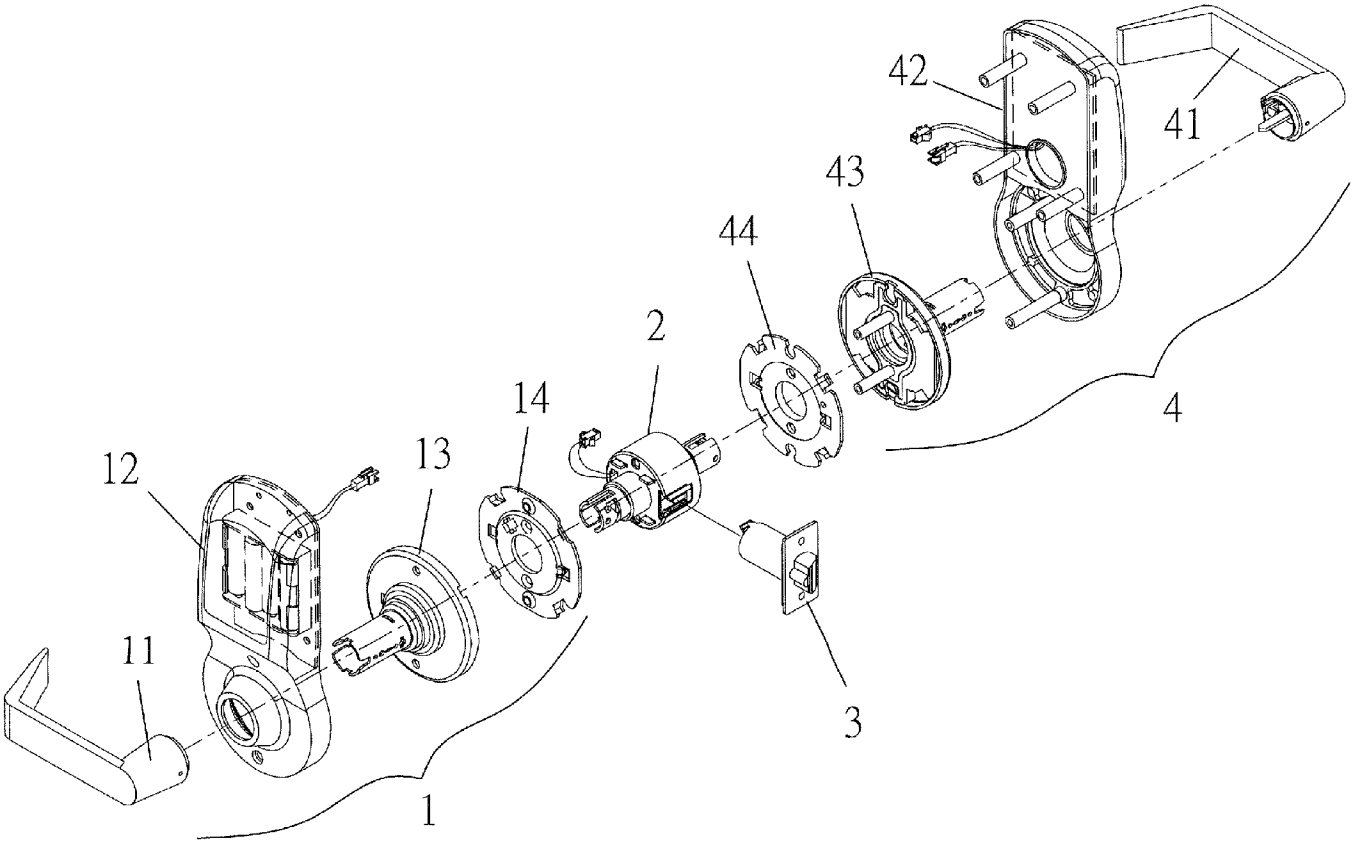
FIG. 1 is an exploded view of a driving structure of an electronic lock according to the present invention.

Referring to FIG. 1, an exploded view is given to illustrate an improved driving structure of an electronic lock according to the present invention, which comprises an outdoor assembly 1, a lock core 2, an indoor assembly 4, and a latch bolt 3. The outdoor assembly 1 is mounted to an outside surface of a door panel. The indoor assembly 4 is mounted to an inside surface of the door panel. The lock core 2 is arranged between the outdoor assembly 1 and the indoor assembly 4 and is coupled thereto. The lock core 2 is operatively coupled to the latch bolt. The outdoor assembly 1 comprises an exterior handle 11, an exterior escutcheon plate 12, an exterior handle stopper 13, and an exterior fixing plate 14. The exterior handle stopper 13 extends through the exterior escutcheon plate 12 and is coupled to the exterior handle 11 and is set at one side of the exterior fixing plate 14. The indoor assembly 4 comprises an interior handle 41, an interior escutcheon plate 42, an interior handle stopper 43, and the interior fixing plate 44. The interior handle stopper 43 extends through the interior escutcheon plate 42 and is coupled to the interior handle 41 and is set at one side of the interior fixing plate 44. The exterior handle 11 further comprises a keyway, a lock cylinder, and a projection pillar. The exterior escutcheon plate 12 comprises a keyboard assembly. The interior escutcheon plate 42 comprises a battery holder is electrically connected to an electrical valve arranged in the lock core 2. The exterior escutcheon plate 12 comprises a circuit board and is electrically connected to the electrical valve arranged in the lock core 2. As such, an improved structure of an electronic lock is constructed.

Figure 2:
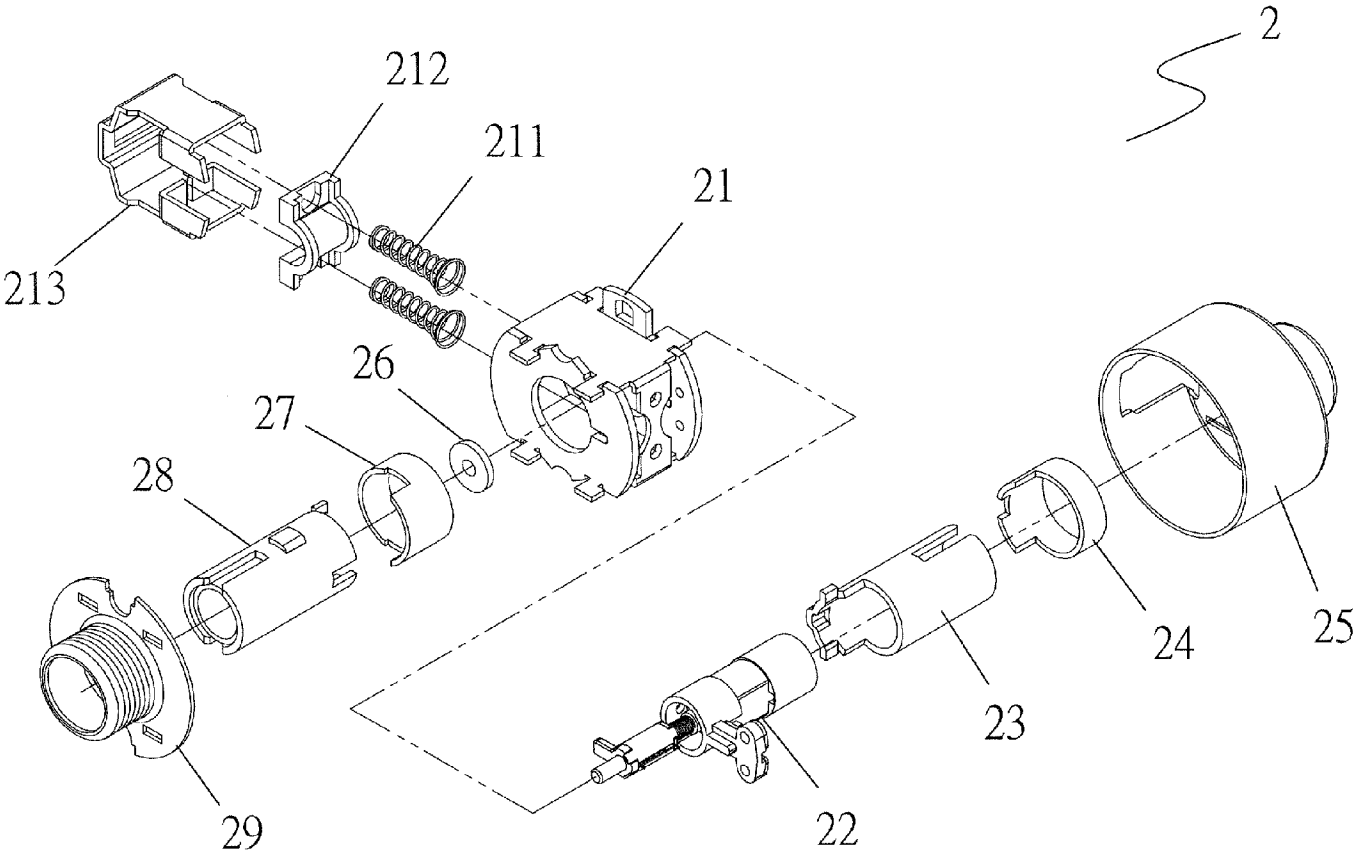
FIG. 2 is an exploded view of a core of the driving structure of the electronic lock according to the present invention.
Figure 3:
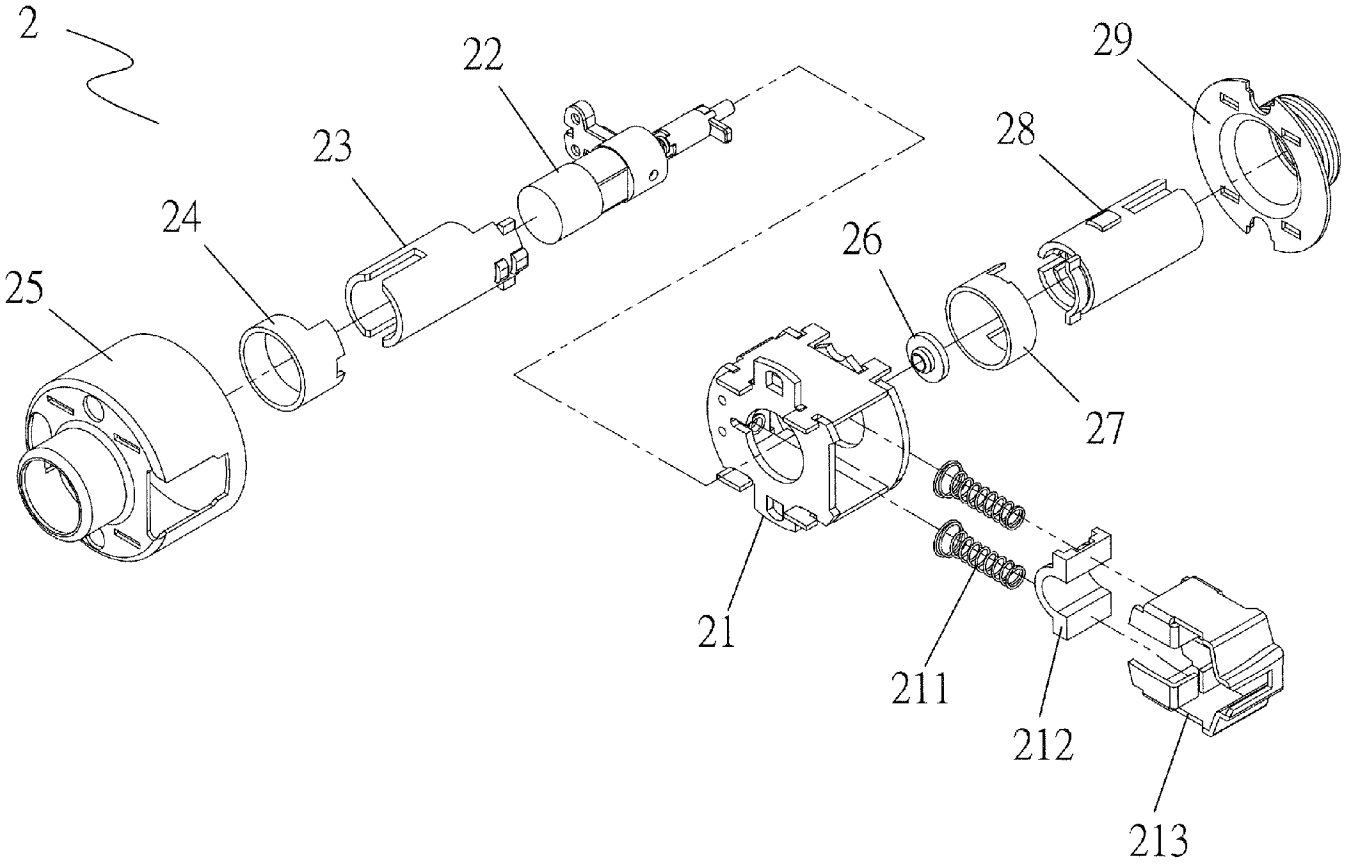
FIG. 3 is an exploded view of the core of the driving structure of the electronic lock according to the present invention taken from a different perspective.

Referring to FIGS. 2 and 3, which are respectively an exploded view of the lock core of the improved driving structure of the electronic lock according to the present invention and a perspective view of the lock core of the improved driving structure of the electronic lock taken from a different perspective, the lock core 2 comprises a lock core base 21, elastic elements 211, a separation plate 212, a latch bolt engagement member 213, an electrical valve 22, a first stopper 23, a first ring 24, a lock core cover 25, a guide plate 26, a second ring 27, a second stopper 28, and a base fixing member 29. The elastic elements 211 and the separation plate 212 are sequentially disposed in the lock core base 21 and then coupled to the latch bolt engagement member 213. The electrical valve 22 is received in the first stopper 23 and the lock core base 21 and the first ring 24 and the lock core cover 25 are sequentially fit to the first stopper 23 and the lock core base 21. The guide plate 26 is disposed in the second stopper 28. The second stopper 28 extends, in sequence, through the second ring 27 and the lock core base 21 and is fixed by the base fixing member 29 in the lock core base 21.

Figure 4:
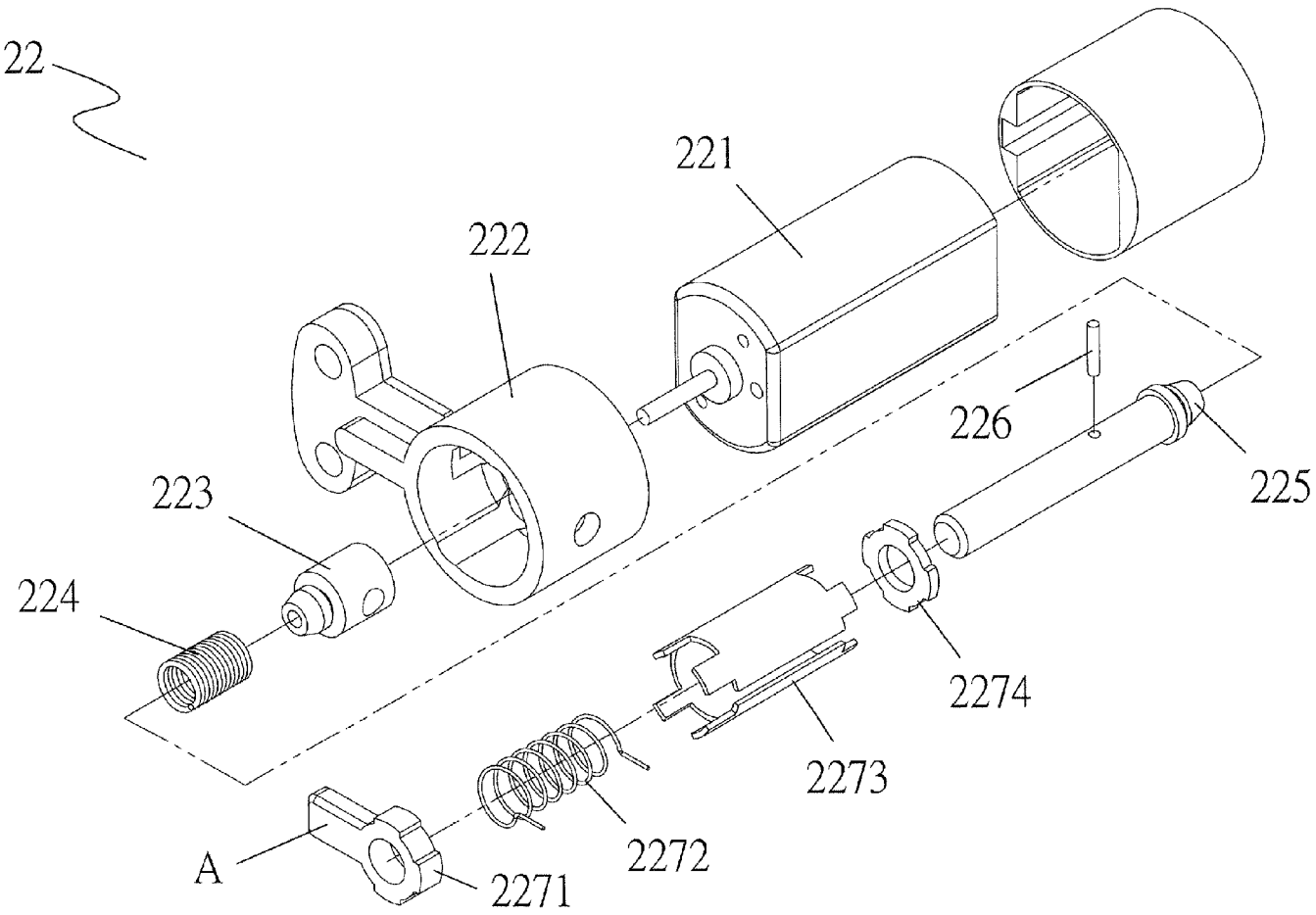
FIG. 4 is an exploded view of an electrical valve of the driving structure of the electronic lock according to the present invention.

Further referring to FIG. 4, which is an exploded view of the electrical valve of the improved driving structure of the electronic lock according to the present invention, as shown in the drawing, the electrical valve 22 comprises a motor 221, a valve housing 222, a rotatable member 223, an elastic transmission member 224, a driven member 225, and a movable member 227. The rotatable member 223, the elastic transmission member 224, the driven member 225, and the movable member 227 are sequentially coupled to the motor 221 and are covered by the valve housing 222. The driven member 225 comprises a guide post 226 mounted thereto. The movable member 227 comprises a first stop plate 2271, a guiding element 2272, a retention device 2273, and a second stop plate 2274. The guiding element 2272 is disposed in the retention device 2273. The retention device 2273 has front and rear ends respectively coupled to the first stop plate 2271 and the second stop plate 2274. The first stop plate 2271 comprises a projection block A formed thereon.

Figure 5:
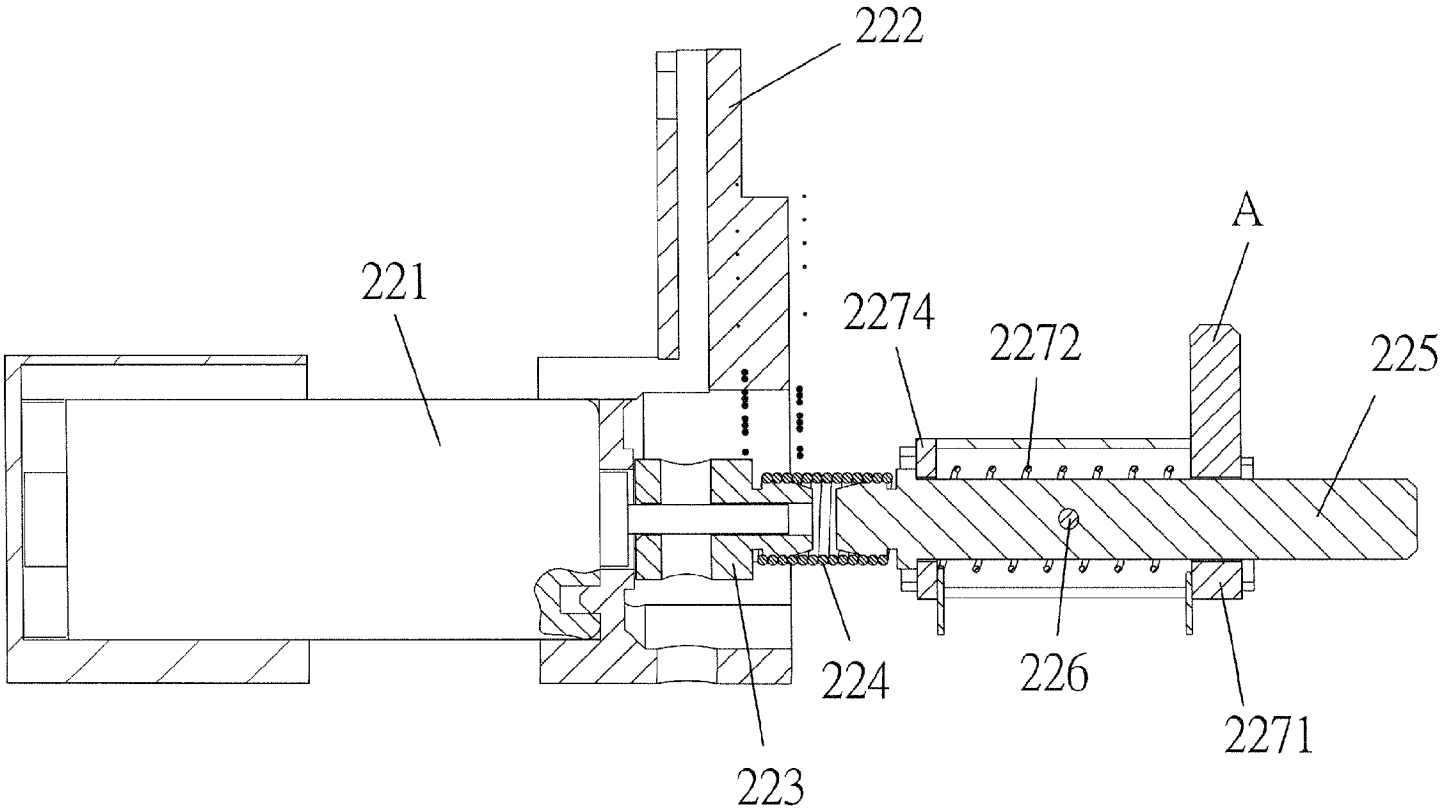
FIG. 5 is a cross-sectional view of the electrical valve of the driving structure of the electronic lock according to the present invention.
Figure 6:
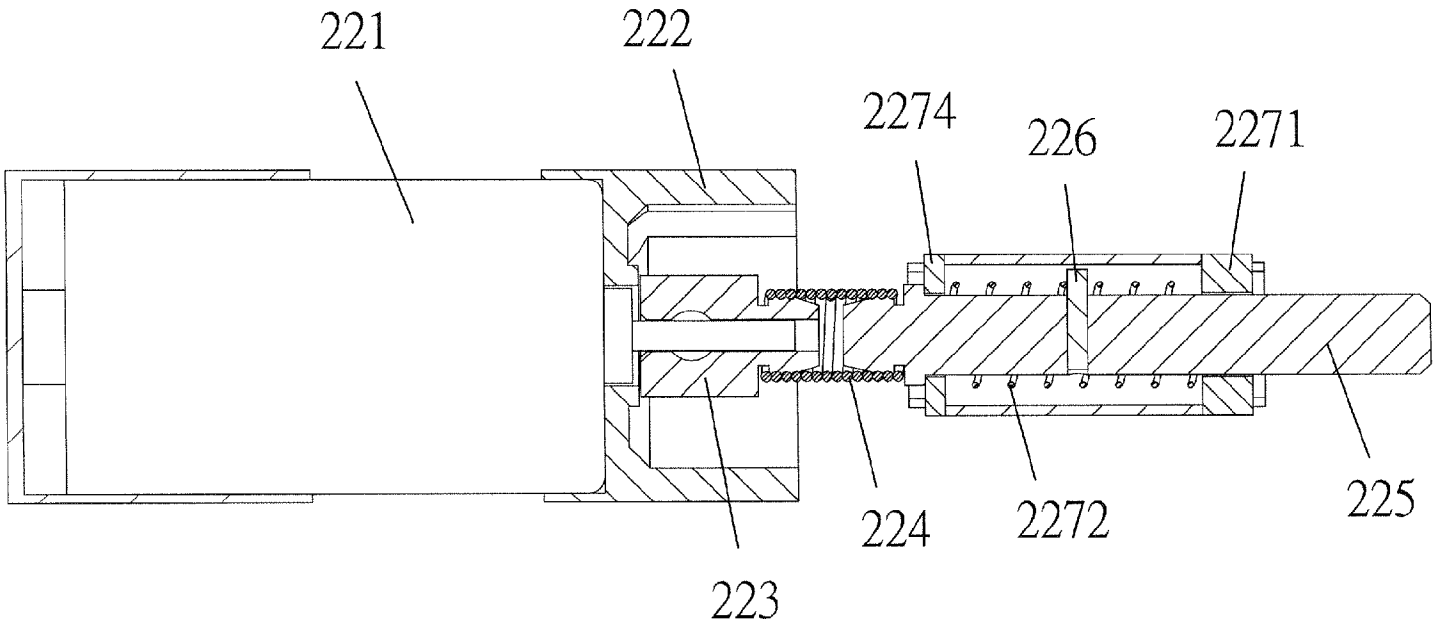
FIG. 6 is a cross-sectional view of the electrical valve of the driving structure of the electronic lock according to the present invention taken from a different angle.
Figure 7:
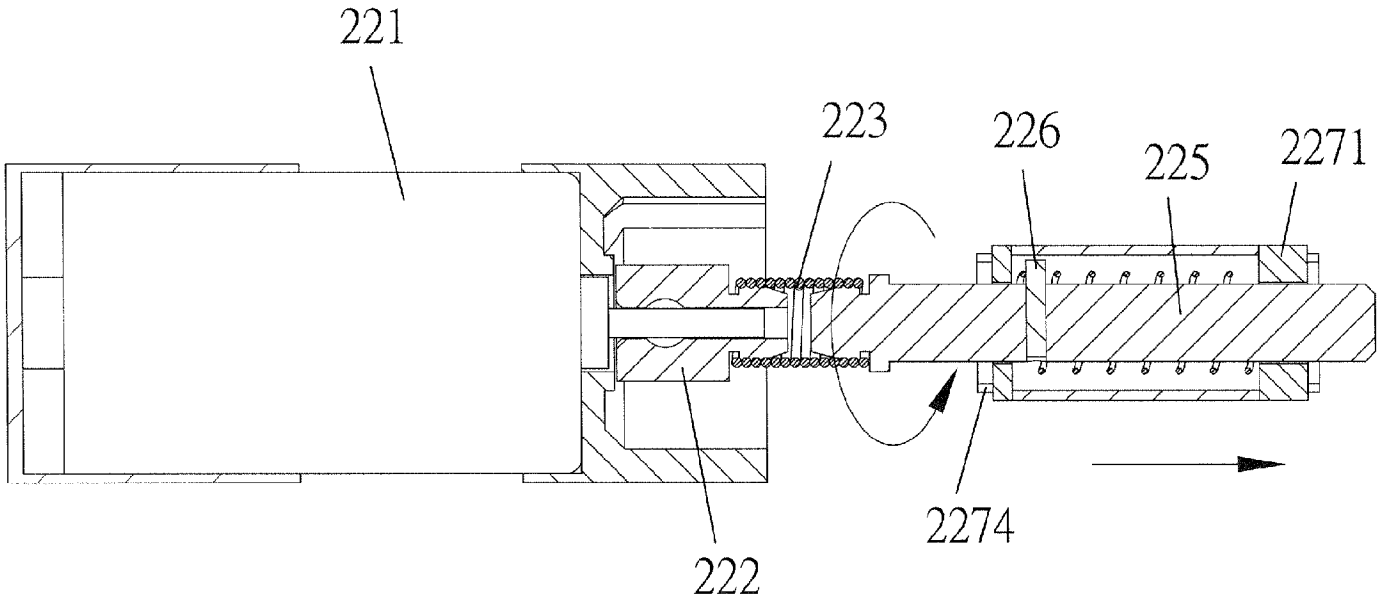
FIG. 7 is a cross-sectional view illustrating an operation of the electrical valve of the driving structure of the electronic lock according to the present invention.
Figure 8:
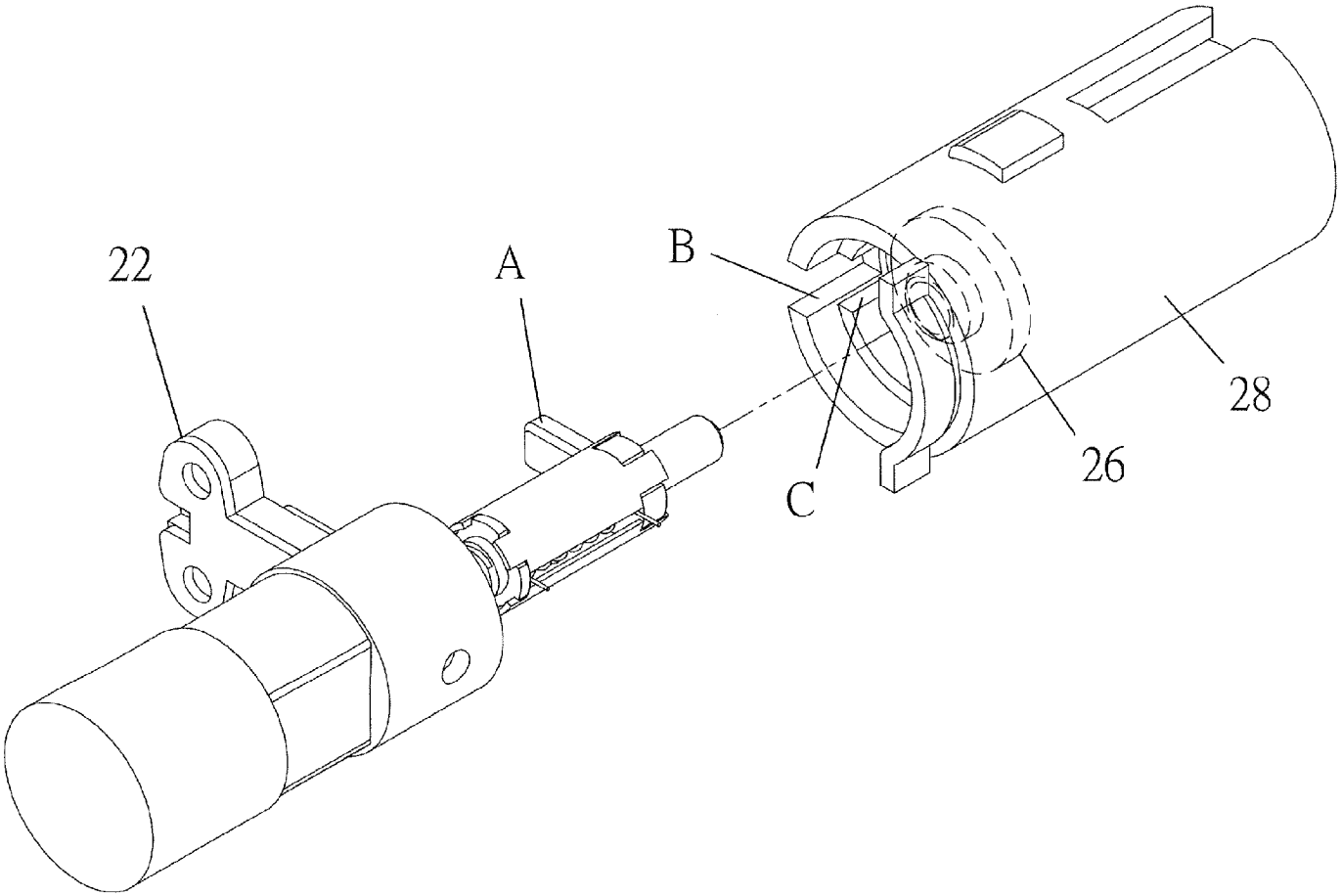
FIG. 8 is a perspective view illustrating a spatial relationship between the electrical valve and a second stopper of the driving structure of the electronic lock according to the present invention.
Figure 9:
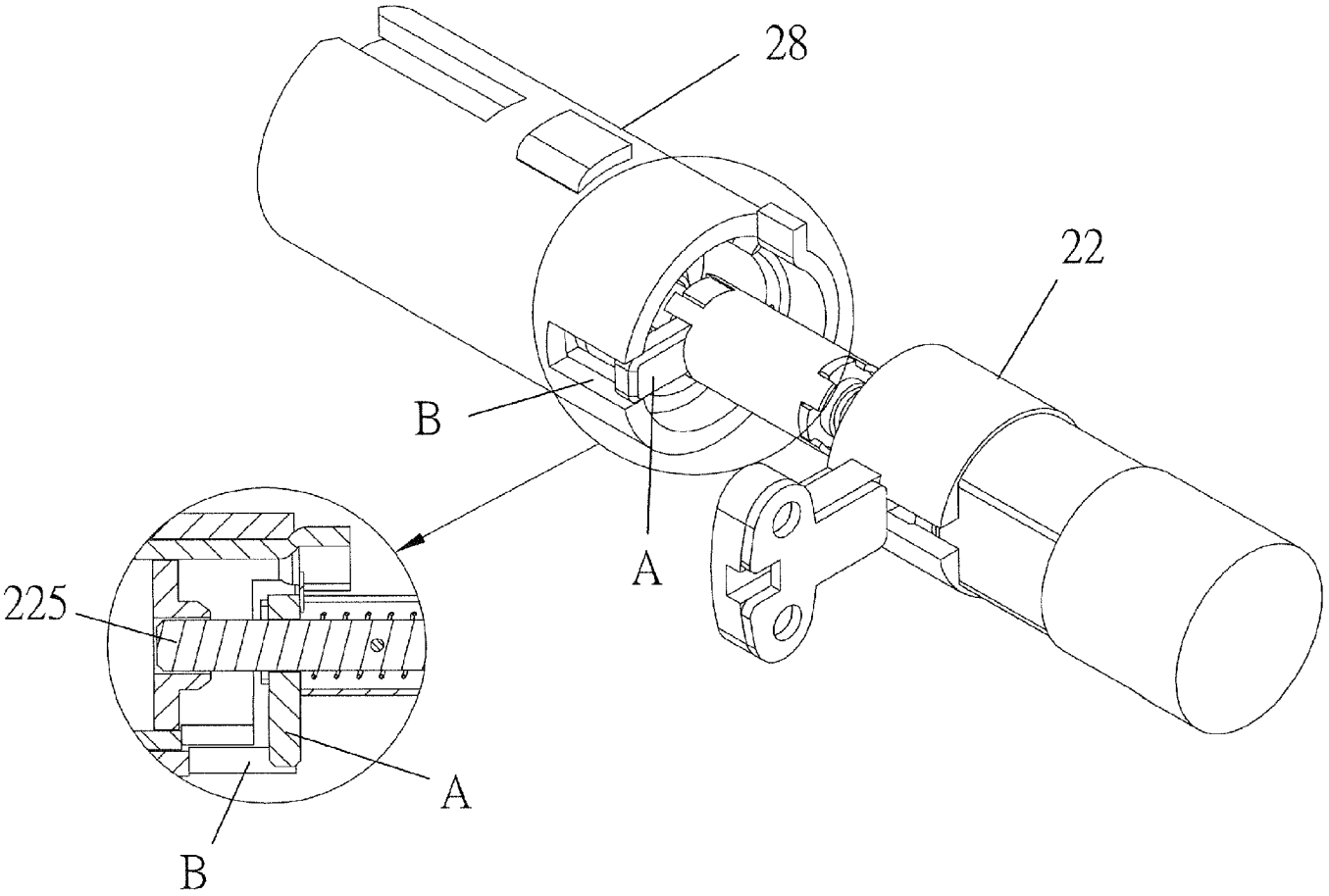
FIG. 9 is a schematic view illustrating coupling engagement of the driving structure of the electronic lock of the present invention.
Figure 10:
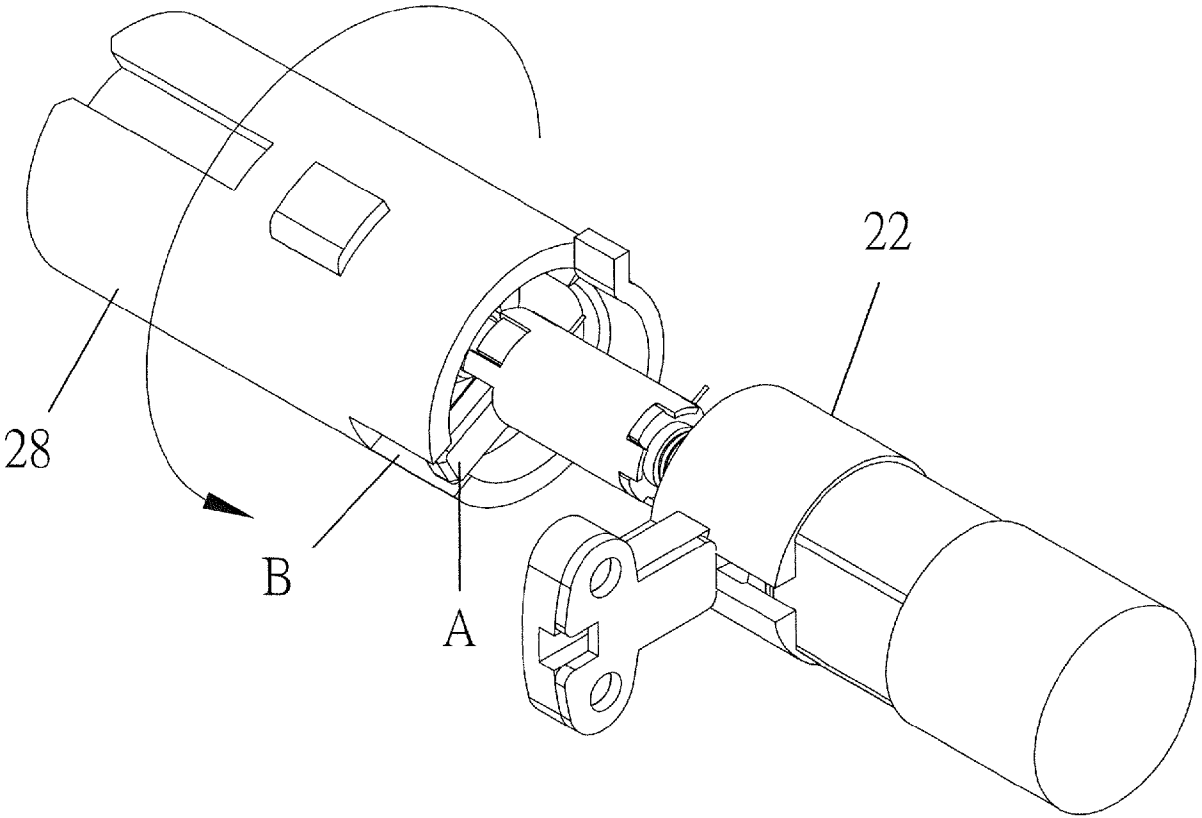
FIG. 10 is a perspective view illustrating an operation of the driving structure of the electronic lock according to the present invention.
Figure 11:
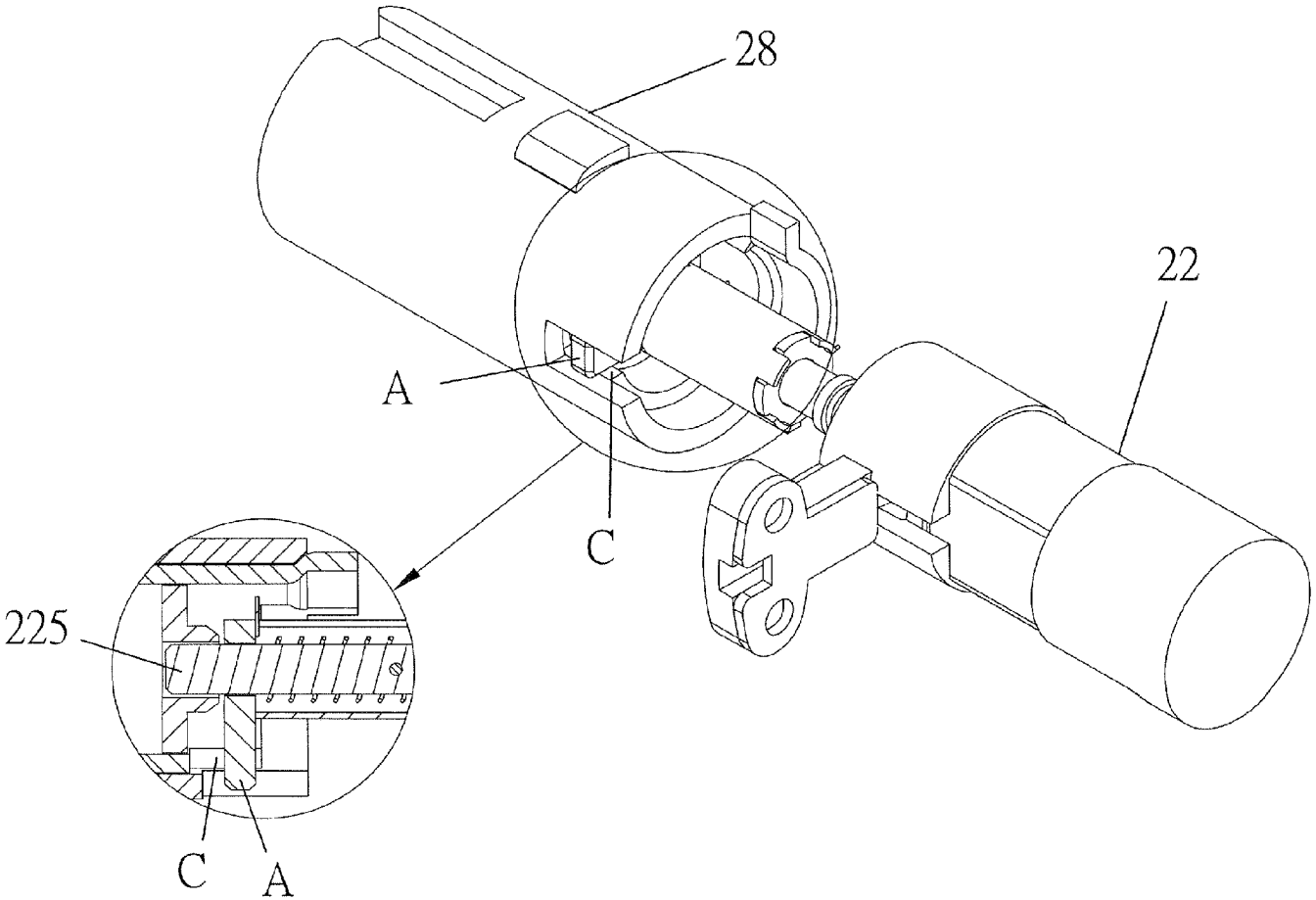
FIG. 11 is a schematic view illustrating coupling engagement of the driving structure of the electronic lock of the present invention.
Figure 12:
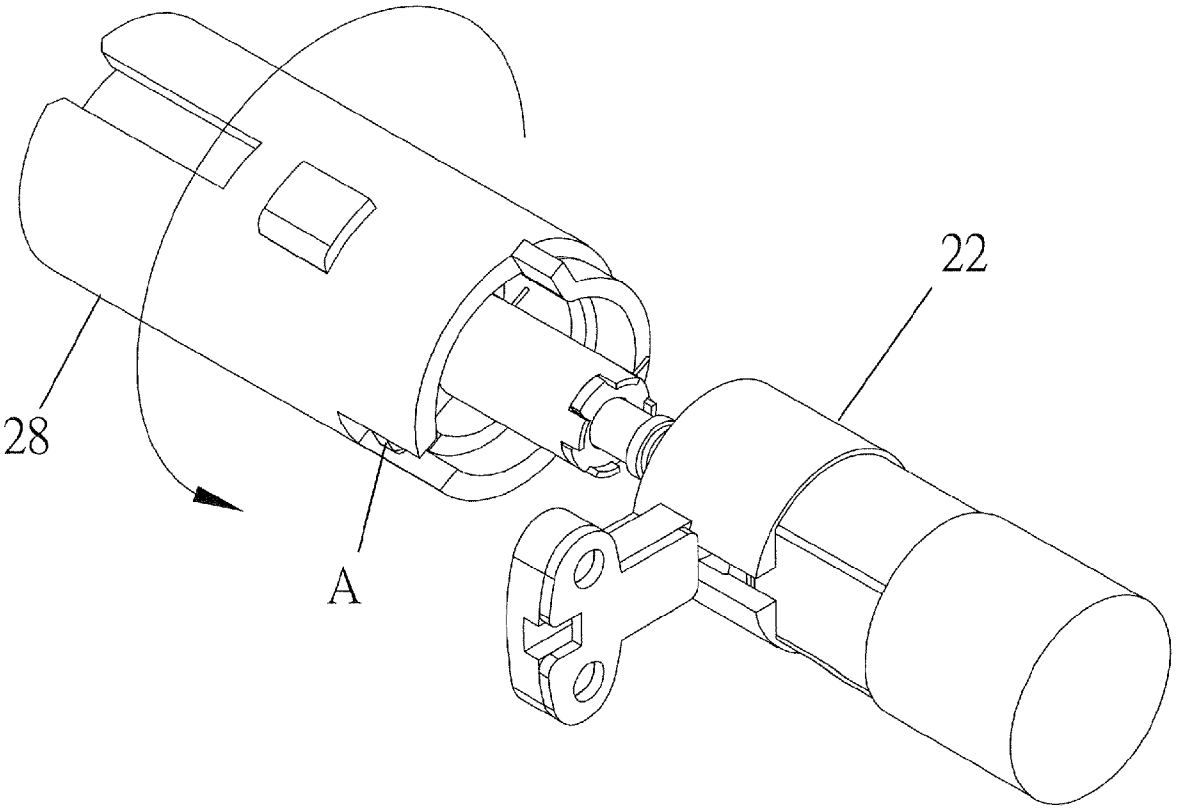
FIG. 12 is a perspective view illustrating an operation of the driving structure of the electronic lock according to the present invention.

Referring to FIGS. 5, 6, and 7, which are respectively a cross-sectional view of the electrical valve of the improved driving structure of the electronic lock according to the present invention, a cross-sectional view of the electrical valve taken from a different angle, and a cross-sectional view illustrating an operation of the electrical valve of the improved driving structure of the electronic lock according to the present invention, as shown in the drawings, the motor 221 is coupled, in sequence, to the rotatable member 223, the elastic transmission member 224, and the driven member 225 and is housed by the valve housing 222. The movable member 227 is fit over the driven member 225. When the motor 221 rotates, since the rotatable member 223, the elastic transmission member 224, and the driven member 225 are coupled to the motor 221, the rotatable member 223, the elastic transmission member 224, and the driven member 225 are caused to rotate with the motor 221. Further, the movable member comprises a first stop plate 2271, a guiding element 2272, a retention device 2273 and a second stop plate 2274. The guiding element 2272 is disposed in the retention device 2273. The retention device 2273 has front and rear end respectively coupled to the first stop plate 2271 and the second stop plate 2274. The first stop plate 2271 comprises a projection block A formed thereon. When the rotatable member 223, the elastic transmission member 224, and the driven member 225 are rotated in unison with the motor 221, with the projection block A being in coupling engagement with a mechanism internal of the lock core and the driven member 225 comprising a guide post 226 that is rotatable as being guided by a track defined by the guiding element 2272, the movable member is stretched out in a forward direction.

Referring to FIGS. 8-12, which are respectively a perspective view illustrating a spatial relationship between the electrical valve and the second stopper of the improved driving structure of the electronic lock according to the present invention, schematic views illustrating coupling engagement thereof, and perspective views illustrating an operation of the improved driving structure of the electronic lock according to the present invention, as shown in the drawings, the second stopper 28 comprises a first guide channel B and a second guide channel C. The driven member 225 of the electrical valve 22 extends through the guide plate 26 and the second stopper 28. The guide plate 26 is fixed to the second stopper 28. The projection block A of the electrical valve 22 is mateable with the first guide channel B and the second guide channel C. Thus, when the projection block A is in mating engagement with the first guide channel B, rotating the exterior handle drives the second stopper 28 to rotate but the second stopper 28 is in a condition of non-operative rotation so that the lock is not unlocked. On the other hand, when the projection block A is in mating engagement with the second guide channel C, rotating the exterior handle drives the second stopper 28 and the second guide channel C and the first guide channel B of the second stopper 28 are in engagement with the projection block A so that the second stopper 28 drives the latch bolt engagement member to move so as unlock the lock.

Figure 13:
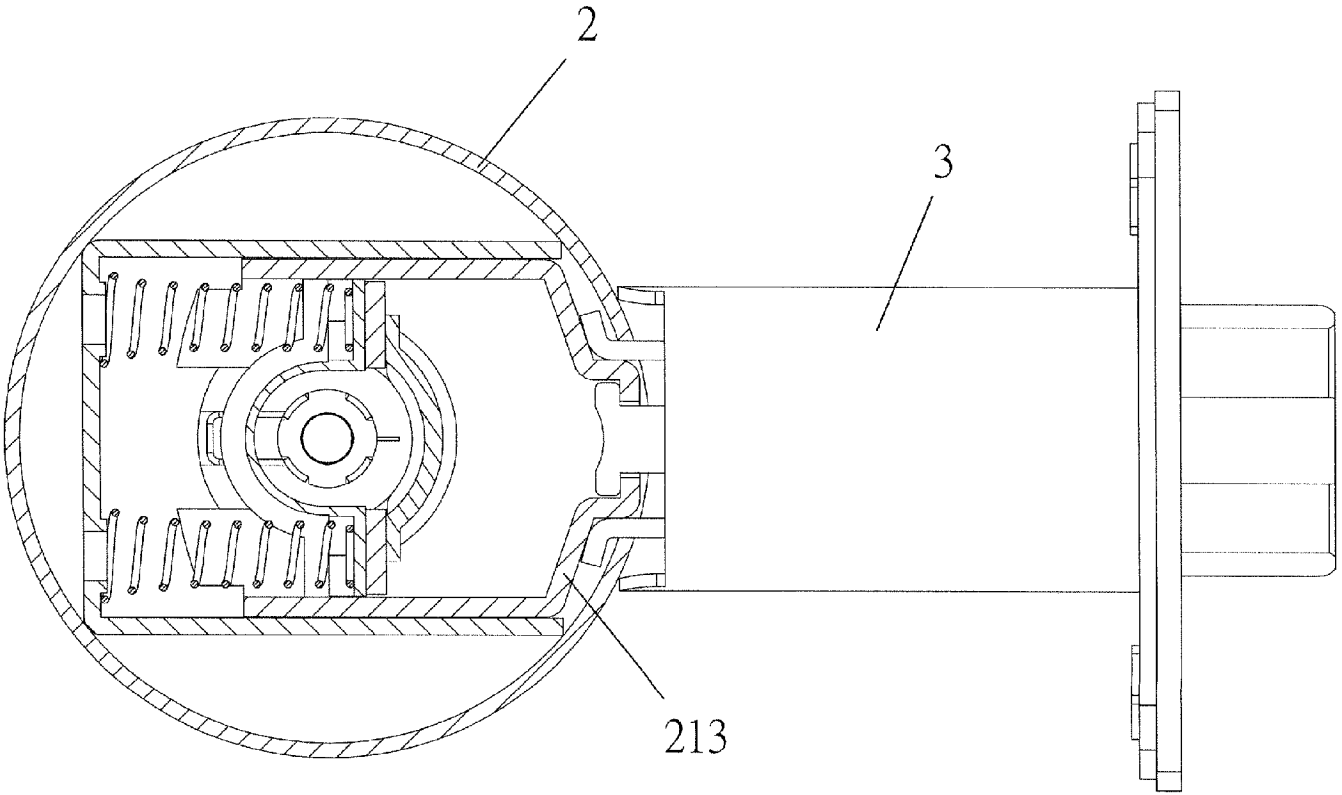
FIG. 13 is a schematic view illustrating the driving structure of the electronic lock according to the present invention before operation.
Figure 14:
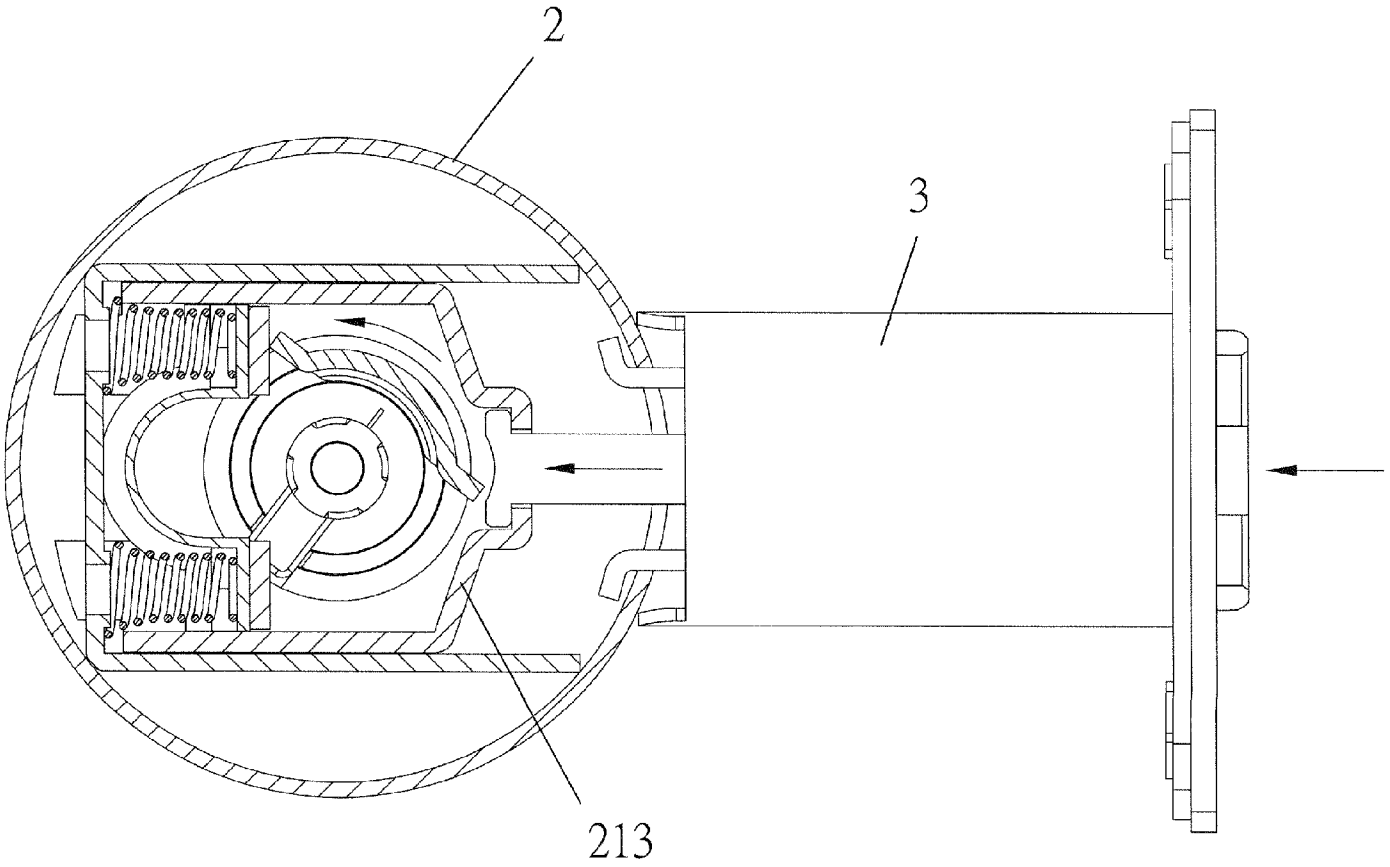
FIG. 14 is a schematic view illustrating an operation of the driving structure of the electronic lock according to the present invention.

Finally, referring to FIGS. 13 and 14, which are schematic views illustrating the improved driving structure of the electronic lock of the present invention in a condition before operation and an operation thereof, as shown in the drawings, the latch bolt engagement member 213 of the lock core 2 is in coupling engagement with the latch bolt 3 so that when the lock core 2 is rotated, the driving member drives the latch bolt engagement member 213 to move so as to cause the latch bolt 3 to move with the latch bolt engagement member 213.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A driving structure of an electronic lock, comprising an outdoor assembly, an indoor assembly, a lock core arranged between the outdoor assembly and the indoor assembly and coupled thereto, and a latch bolt operatively coupled to the lock core, the outdoor assembly being adapted to be mounted to an outside surface of a door panel, the indoor assembly being mounted to an inside surface of the door panel, the lock core being arranged between the outdoor assembly and the indoor assembly and coupled thereto, the lock core being operatively coupled to the latch bolt;

characterized in that the lock core comprises a lock core base, elastic elements, a separation plate, a latch bolt engagement member, an electrical valve, a first stopper, a first ring, a lock core cover, a guide plate, a second ring, a second stopper, and a base fixing member, the elastic elements and the separation plate being sequentially disposed in the lock core base and then coupled to the latch bolt engagement member, the electrical valve being received in the first stopper and the lock core base, the first ring and the lock core cover being sequentially fit to the first stopper and the lock core base, the guide plate being disposed in the second stopper, the second stopper extending, in sequence, through the second ring and the lock core base and fixed by the base fixing member in the lock core base;

wherein the electrical valve comprises a motor, a valve housing, a rotatable member, an elastic transmission member, a driven member, and a movable member, the rotatable member, the elastic transmission member, the driven member, and the movable member being sequentially coupled to the motor and covered by the valve housing, the driven member comprising a guide post mounted thereto, the movable member comprising a first stop plate, a guiding element, a retention device, and a second stop plate, the guiding element being disposed in the retention device, the retention device having front and rear ends respectively coupled to the first stop plate and the second stop plate.

2. The improved structure of the electronic lock as claimed in claim 1, wherein the outdoor assembly comprises an exterior handle, an exterior escutcheon plate, an exterior handle stopper, and an exterior fixing plate, the exterior handle stopper extending through the exterior escutcheon plate and coupled to the exterior handle and set at one side of the exterior fixing plate.

3. The improved structure of the electronic lock as claimed in claim 1, wherein the indoor assembly comprises an interior handle, an interior escutcheon plate, an interior handle stopper, and an interior fixing plate, the interior handle stopper extending through the interior escutcheon plate and coupled to the interior handle and set at one side of the interior fixing plate.

* * * * *